United States Patent [19]

Hackney

[11] 4,218,986

[45] Aug. 26, 1980

[54] BOAT RUDDER ACCESSORY

[76] Inventor: John Hackney, 1026 NW. 16th St., Stuart, Fla. 33494

[21] Appl. No.: 930,427

[22] Filed: Aug. 2, 1978

[51] Int. Cl.[2] ..... B63H 25/06

[52] U.S. Cl. ..... 114/165

[58] Field of Search ..... 114/162, 163, 164, 165, 114/130, 131, 132, 133

[56] References Cited

U.S. PATENT DOCUMENTS

| | | | |
|---|---|---|---|
| 2,991,749 | 7/1961 | Patterson | 114/132 |
| 3,575,124 | 4/1971 | Alter | 114/165 R |
| 3,921,561 | 11/1975 | Arce | 114/165 R |

*Primary Examiner*—Trygve M. Blix
*Assistant Examiner*—Jesus D. Sotelo
*Attorney, Agent, or Firm*—Carroll F. Palmer

[57] ABSTRACT

A rudder position return device for a boat rudder of the kick-up type comprises a U-shaped clip with lateral lugs, an elastic band to be stretched across the aft side of the rudder and be fastened to the clip at its fore side and a pair of dish-shaped washers to fasten on each side of the rudder above the band to act as stops for the band when the rudder is in a fully kicked-up position.

1 Claim, 8 Drawing Figures

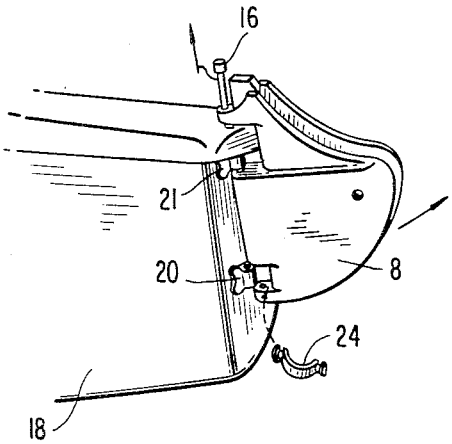
FIG. 4
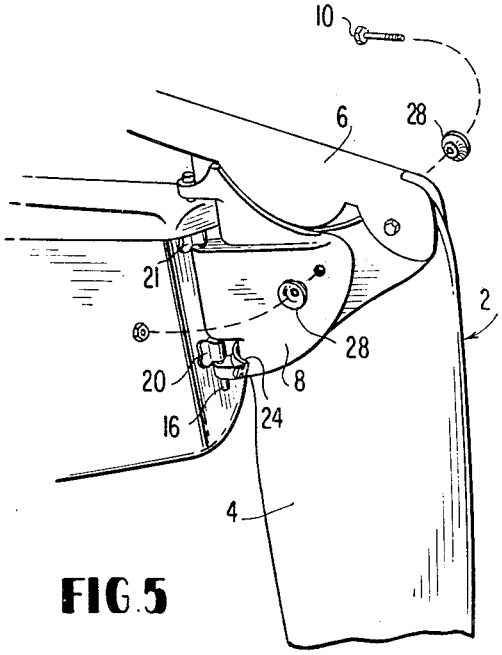
FIG. 5
FIG. 6
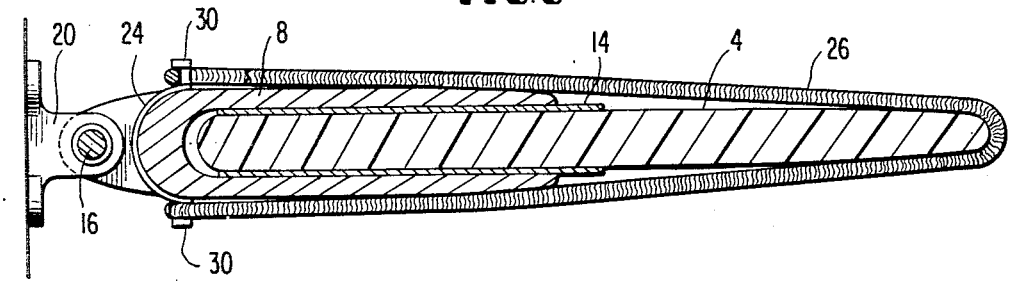
FIG. 8
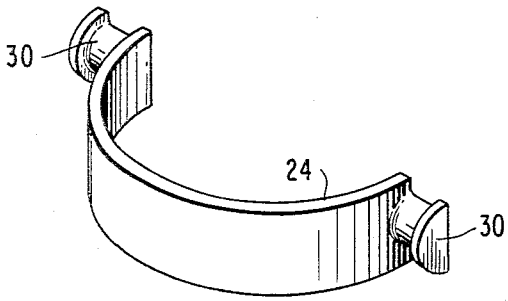
FIG. 7
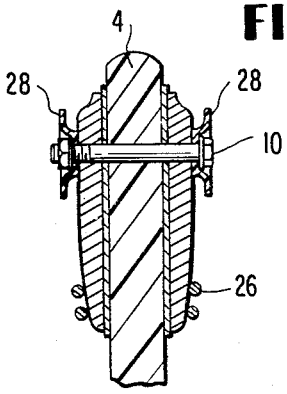

BOAT RUDDER ACCESSORY

BACKGROUND OF THE INVENTION

1. Field of the Invention

The invention relates broadly to accessories for boat rudders. More particularly, it concerns elastic band means to assist in retaining a kick-up type boat rudder in the fully descended position or in returning it to such position from a kicked-up position.

2. Description of the Prior Art

A variety of sailboats are equipped with rudders that are hinged near the top so that they can move from a fully descended location where they are positioned for normal steering of the sailboat to a fully elevated (kicked-up) location where the rudder will be out of the water. Of course, such so-called "kick-up" rudders may assume other positions between the fully descended position and the fully kicked-up positon. The kick-up feature is provided to prevent the rudders from being damaged or completely broken off from the boat when the boat hits a shoal or is run up on a beach as the boat is brought through the surf at a seashore. Such rudders are popular on racing dinghies and catamarans, e.g., "Hobie Cat" class sailboats.

The kick-up type rudders unfortunately present some problems in the use of boats. Thus, in strong winds and accompanying rough water, such rudders can be kicked-up so that steerage is lost. Also, because such rudders are somewhat awkward to reach at the stern of the boat while under sail, it can be difficult to apply suffient force to them to return them to a fully descended position when they have been kicked-up.

OBJECTS

A principal object of this invention is to provide boat rudders of the kick-up type with means to assist in retaining the rudder in a fully descended positon even under adverse wind and sea conditons.

Another object is to provide means by which rudders of the kick-up type may more easily be moved into proper steerage position while the boats on which they are installed are underway.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished according to the present invention by providing kick-up type boat rudders with an accessory which comprises a U-shaped clip positioned behind the foreside of the rudder, an elastic band stretched across the aft side of the rudder and fastened to the U-shaped clip and a pair of dish-shaped washers fixed on each side of the rudder above the elastic band that act as stops for the elastic band when the rudder is in a kicked-up position.

BRIEF DESCRIPTION OF THE DRAWINGS

A more complete understanding of the invention may be had by reference to the accompanying drawing in which:

FIG. 4 is a perspective view illustrating a step in applying the accessory of the invention to a boat rudder.

FIG. 5 is a perspective view illustrating another step in the accessory installation.

FIG. 6 is a sectional view taken on the line 6—6 of FIG. 1.

FIG. 7 is a sectional view taken on the line 7—7 of FIG. 1.

FIG. 8 is an isometric view of the U-shaped clip of the rudder accessory.

DESCRIPTION OF THE PREFERRED EMBODIMENTS

Figure 1:
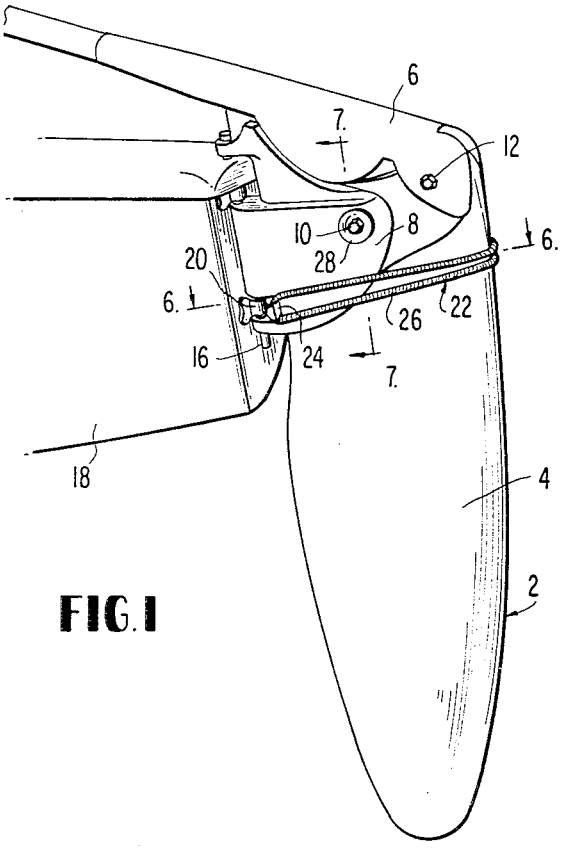
FIG. 1 is a perspective view of a kick-up type boat rudder in its fully descended position equipped with the rudder accessory of the invention.

Referring in detail to the drawings, the kick-up type rudder assembly 2 comprises the rudder 4, tiller 6, rudder housing 8, rudder pivot bolt 10, tiller pivot bolt 12, top plate 14 and pintle 16 mounted on boat hull 18 by the gudgeons 20 and 21.

The rudder accessory 22 of the invention comprises the U-shaped member 24, elastic band 26 and dish-shaped washers 28. The member 24 has lugs 30 extending laterally therefrom at each side (see FIG. 8).

To install the accessory 22 on a boat (see FIGS. 4 & 5), the pintle 16 is lifted as indicated by the arrow in FIG. 4 until it clears the lower gudgeon 20. The rudder housing 8 is moved aft to provide room so the clip 24 may be slipped into positon behind the aforeside of the rudder 4 and housing 8. The pintle 16 is then replaced and the elastic band 26 is stretched across the aft side of rudder 4 and hooked over the lugs 30 of clip 24. Finally, the bolt 10, which holds the rudder 4 on the housing 8, is removed, the washers 26 are positioned on each side of the rudder 4 and the bolt 10 is reinserted and tightened in pivot position.

Figure 2:
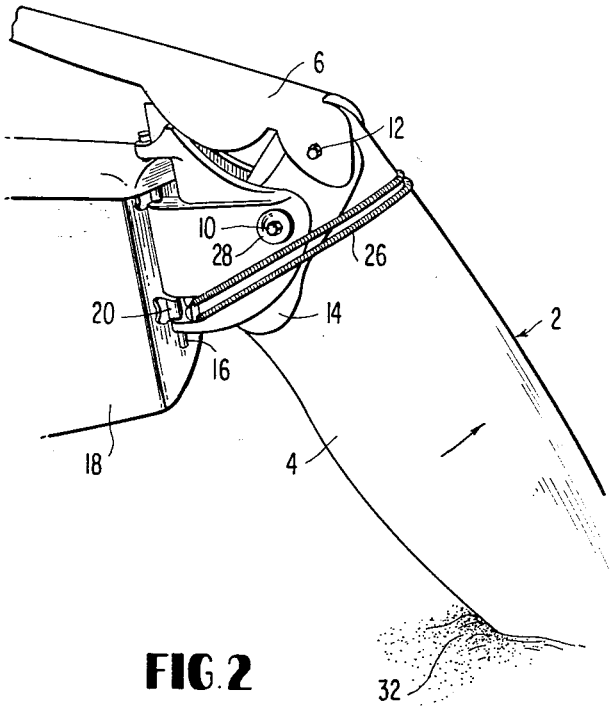
FIG. 2 is a perspective view similar to FIG. 1, but with the rudder in a partially kicked-up position.
Figure 3:
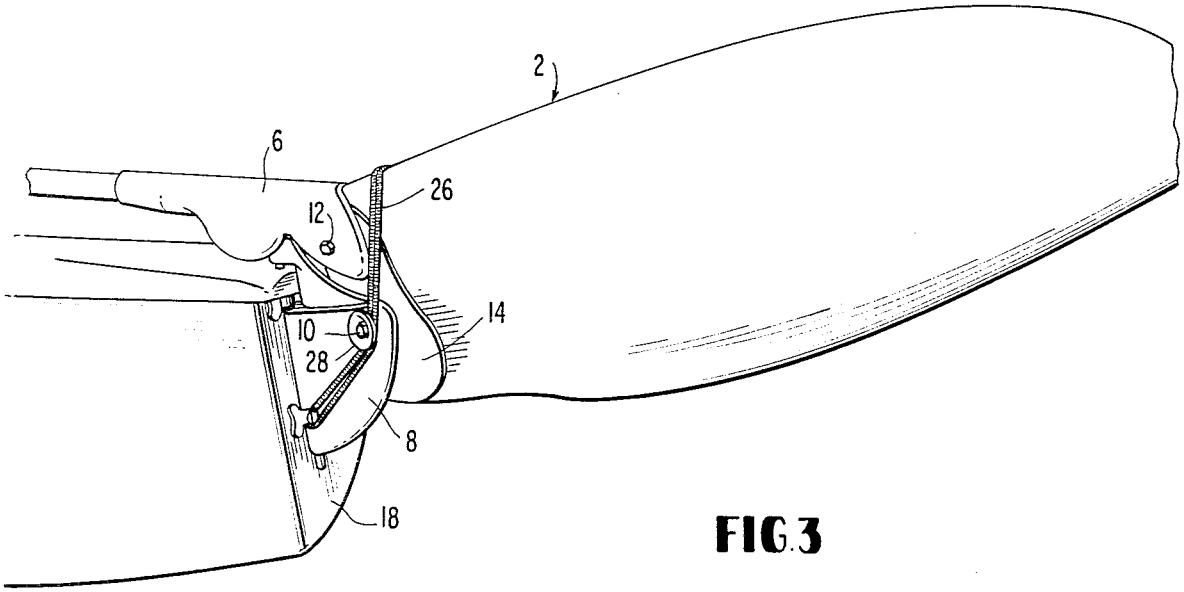
FIG. 3 is a perspective view similar to FIG. 1, but with the rudder in a fully kicked-up position.

With the rudder in the fully descended position as shown in FIG. 1, the tension applied by the elastic band 26 holds the rudder 4 down even against the adverse force of rough water that can be generated by strong winds. If the rudder 4 should strike a shoal 32 forcing the rudder 4 to be partially kicked-up as shown in FIG. 2, the elastic band 26 will act to return the rudder to the steerage position as seen in FIG. 1. When the rudder is moved to a fully kicked-up position, such as when the boat is beached, the washers 28 act as stops for the elastic band 26 to prevent the band from snapping off the rudder 4. When the rudder is in such position (see FIG. 3), the force applied to the rudder 4 by band 26 helps the boat user to quickly and easily return the rudder 4 to the steerage position as shown in FIG. 1. Such a maneuver is required, for example, when the sailboat is taken into the surf from a beach as soon as the boat reaches water deep enough for the rudder to be lowered into steerage position. Without the accessory of the invention, such rudder lowereing can be quite difficult due to its awkward position at the stern of the boat hull 18.

When the boat is not in use, the elastic band 26 may be removed from the boat and stored to keep in away from the damaging effects of the sun and heat. The clip 24 and washers 28, on the other hand, may be left on the boat ready to receive the band 26 when the boat is again sailed.

The embodiments of the invention in which an exclusive property or privilege is claimed are defined as follows:

1. Means for use with a boat rudder of the kick-up type to assist in retaining the rudder in its fully descended position or in returning it to said position from a kicked-up position which comprises a U-shaped member having a lug extending laterally therefrom at each side, said lugs being spaced apart sufficiently to enable them to extend beyond the sides of a rudder when said member is positioned behind the aforeside of the rudder, an elastic band that may be strethced across the aft side of said rudder and fastened to said U-shaped member aft side of said rudder and fastened to said U-shaped member lugs, and a pair of dish-shaped washers fixed by the rudder hinge bolt at each side of the rudder above said elastic band, said washers acting as stops for said elastic band when the rudder is in a fully kicked-up position.

* * * * *